US005171928A

United States Patent [19]

Kim

[11] Patent Number: 5,171,928

[45] Date of Patent: Dec. 15, 1992

[54] MEMORY FOR ELECTRONIC RECORDING APPARATUS USING STANDARD MELODY NOTE-LENGTH TABLE

[75] Inventor: Jae H. Kim, Kyonggy-Do, Rep. of Korea

[73] Assignee: Goldstar Co., Ltd., Rep. of Korea

[21] Appl. No.: 615,976

[22] Filed: Nov. 20, 1990

[30] Foreign Application Priority Data

Nov. 30, 1989 [KR] Rep. of Korea ..... 17650/1989

[51] Int. Cl.[5] ..... G10H 7/00

[52] U.S. Cl. ..... 84/609; 84/649

[58] Field of Search ..... 84/613, 617, 620, 686, 84/634, 601, 609, 649, 602

[56] References Cited

U.S. PATENT DOCUMENTS 4,785,703 11/1988 Ichiki ..... 84/634
4,953,438 9/1990 Shibukawa ..... 84/649
4,987,600 1/1991 Rossum ..... 84/603

*Primary Examiner*—William M. Shoop, Jr.

*Assistant Examiner*—Helen Kim

*Attorney, Agent, or Firm*—Anthony J. Casella; Gerald E. Hespos

[57] ABSTRACT

A music recording system on electronic keyboard is disclosed, and the system includes: a key scanning circuit for reading and interpreting the key data from the key board, and for outputting a note number data and a key on/off information: a counter for counting the input signals in accordance with the system clock and based on the key on/off information from the key scanning circuit; a register for latching the content of the counter upon completion of the counting; a pointer generator for looping the length data of the notes and rest; another register for temporarily storing the length data of the notes and rests read by the pointer generator; a comparator for comparing the data latched in the registers; and an output control circuit for forming into byte forms the data of the counted values of the register and the note number data of the key scanning circuit. According to the present invention, a long melody can be stored with a small memory capacity.

3 Claims, 4 Drawing Sheets

| NOTE | DATA | REST | DATA |
|---|---|---|---|
| 64TH NOTE | Ø | 64TH REST | Ø |
| DOTTED 64TH NOTE | 1 | DOTTED 64TH REST | 1 |
| THREE CONTINUOUS 64TH NOTE | 2 | 32ND REST | 2 |
| 32ND NOTE | 3 | DOTTED 32ND REST | 3 |
| ⋮ | ⋮ | ⋮ | ⋮ |
| HALF NOTE | DN1 | HALF REST | Dr1 |
| DOTTED HALF NOTE | DN2 | WHOLE REST | Dr2 |
| WHOLE NOTE | DN3 | ⋮ | ⋮ |
| ⋮ | ⋮ | ⋮ | ⋮ |

MEMORY FOR ELECTRONIC RECORDING APPARATUS USING STANDARD MELODY NOTE-LENGTH TABLE

FIELD OF THE INVENTION

The present invention relates to a music recording system on electronic keyboard and particularly to music recording system in which a music performed by a player can be recorded into a memory of small capacity in an electronic keyboard.

BACKGROUND OF THE INVENTION

As shown in FIG. 1, the conventional technique is constituted such that: a key scanning circuit 1 is not only connected to a counter 2 directly but also connected through an inverter N1; further the key scanning circuit 1 is connected to an output control circuit 3; the counter 2 to which clocks CK are supplied is connected to the output control circuit 3; and the output control circuit 3 is connected to a RAM 4.

Further as shown in FIG. 2, the data for use in the RAM 4 consists of 3 bytes, and the upper two bytes represent the information on the note length, while the lower one byte represents the note number. Here "N/R" is a bit for showing as to whether it is a note or a rest. When this bit is set as a rest, the note number data consisting of 3 bytes are not required, but the expression becomes possible by means of only two bytes. Further, the 7th bit P of the third byte is a polyphonic bit which is set upon entering of a polyphonic key input.

Referring to FIG. 1, the key information inputted from the key scanning circuit 1 is interpreted, before breaking it down into a key number data NN a key-on data No and a key-off data Nf, and the N/R bit of FIG. 2 is set by means of the key-on data No and the key-off data Nf, while the on and off times are respectively counted by means of the counter 2 based on the system clock CK. Thus, upon completion of the counting, the counted values of the counter 2 are assigned to the note length bit of FIG. 2, while, in the case of a note, it is recorded on the RAM 4 together with the note number data.

Under this condition, a polyphonic bit P is set upon a polyphonic key input, and the next key data of the pressed key continuously sets the polyphonic bit P, so that the chord input can be discriminated.

Further, the data of the note length consists of 15 bits, and therefore, an amount of data equivalent to $2^{15}$(=32,768) times the length of the system clock can be stored.

However, according to this conventional music recording method, in the case where the system clock CK is 10 [ms], and where the playing is made at the standard speed (d=120), the time interval of a quarter note is 0.5 seconds, and therefore, the recording can be made in the amount of over 600 notes of 15-bit length data for the time interval of over 300 seconds.

This is equivalent to one complete melody, and if the recording exceeds 5 minutes which is the maximum time for the notes. It is impossible to record anymore because the memory is squandered.

SUMMARY OF THE INVENTION

It is the object of the present invention to provide a music recording system on electronic keyboard, in which the disadvantages of the conventional system can be overcome.

BRIEF DESCRIPTION OF THE DRAWINGS

The above object and other advantages of the present invention will become more apparent by describing in detail the preferred embodiment of the present invention with reference to the attached drawing in which.

DESCRIPTION OF THE PREFERRED EMBODIMENT

Figure 1:
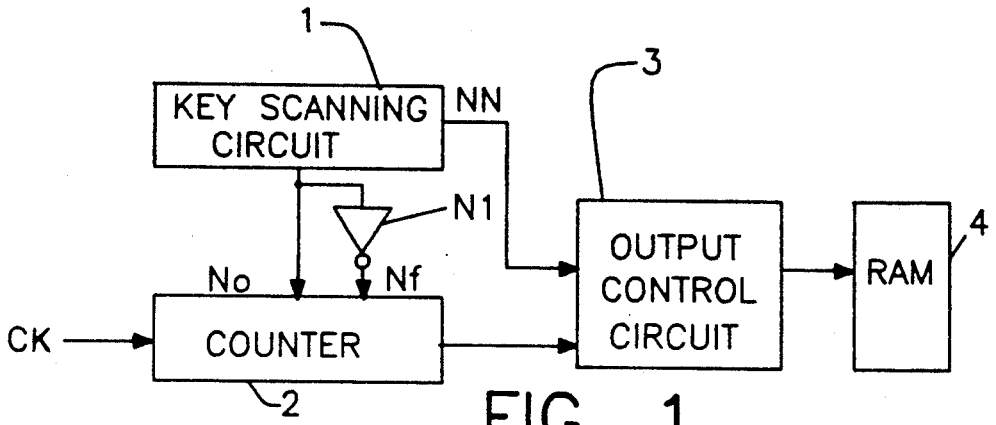
FIG. 1 (PRIOR ART)
FIG. 1 is a block diagram showing the constitution of the conventional system.
Figure 2:
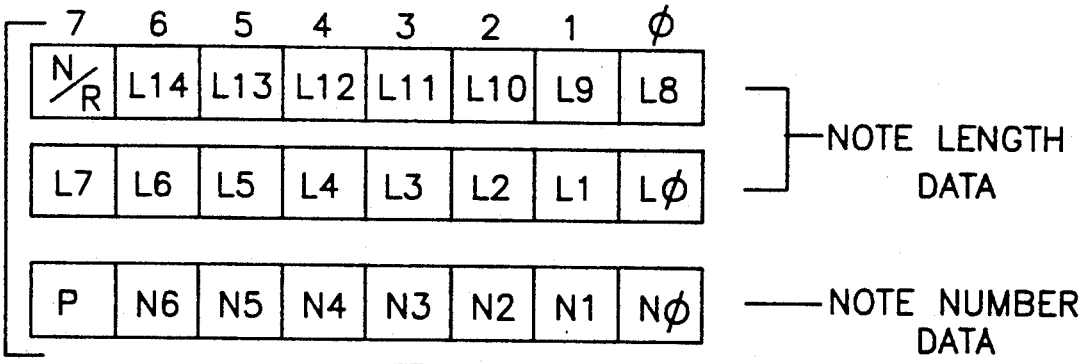
FIG. 2 (PRIOR ART)
FIG. 2 illustrates the structure of the data of the conventional system.
Figure 3:
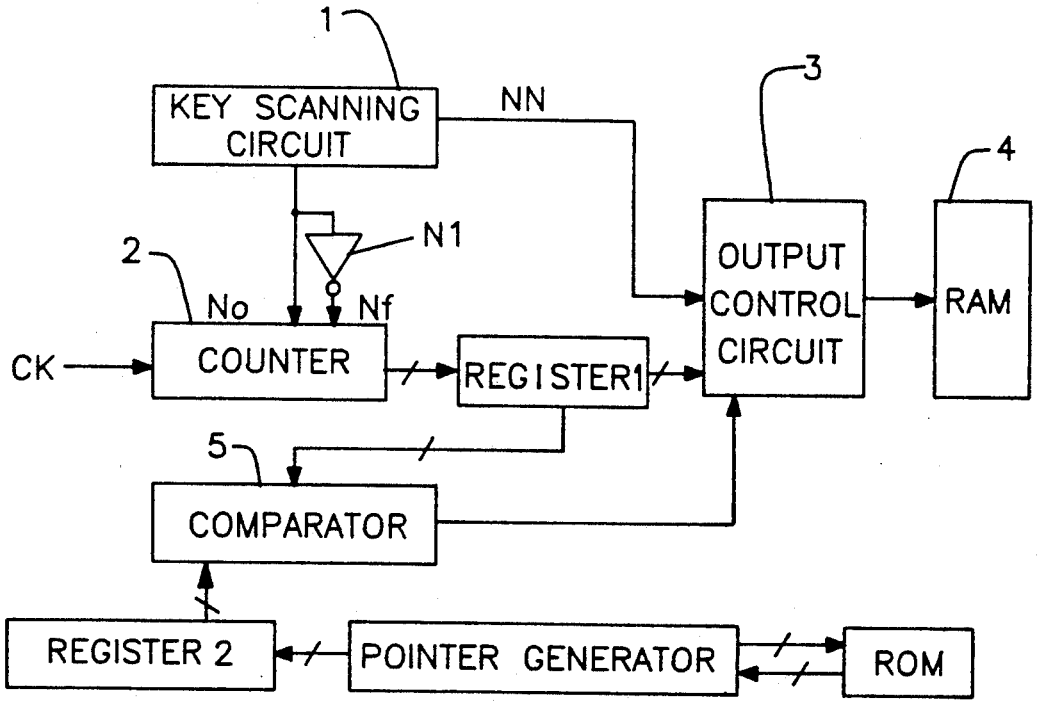
FIG. 3 is a block diagram showing the block diagram of the circuit according to the present invention.

As shown in FIG. 3, a key scanning circuit 1 which is for reading and interpreting the information of the key-on/off notes is not only connected directly to a counter 2 but also connected through an inverter N1. The counter 2 which receivers clocks CK is connected to a register Rg1, and the register Rg1 which is for latching the contents of the counter 2 upon completion of the counting is connected to both a comparator 5 and a control circuit 3. Another register Rg2 which is connected to the comparator 5 and which compares the note on/off time and the standard note length is connected through a pointer generator PG to a ROM Rn, the pointer generator PG being for looping the standard note length table, in the ROM Rn being for storing the note length table.

Figures 5, 6:
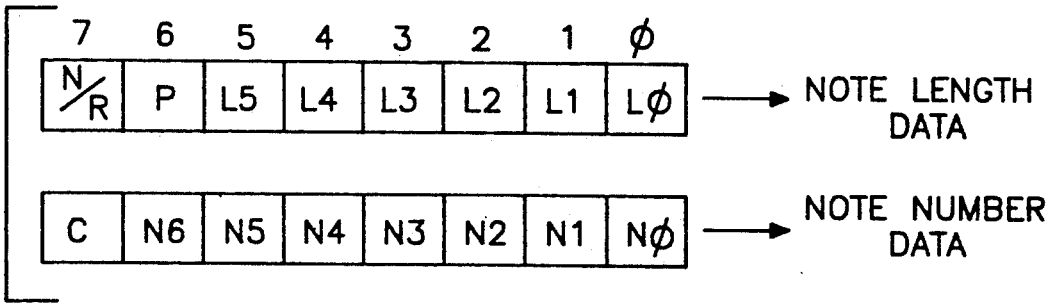
FIG. 5 is a table showing the data codes for the notes according to the present invention.
FIG. 6 illustrates the structure of the data according to the present invention.

The RAM 4 is connected to an output control circuit 3 which is for generating the data for use in the RAM 4 in accordance with the counted value of the register Rg1, the output of the comparator 5 and the note number data of the key scanning circuit 1. the ROM Rn stores the note length table of FIG. 5. That is, there are recorded the data for notes and rests, and the recorded data (note length data and note number data) consists of two bytes as shown in FIG. 6. The "N/R" bit of the first byte (note length data) is a note/rest bit, and the "P" bit is a polyphonic bit, while the "C" bit of the second byte (note number data) is a continuity bit which is for continuously displaying the length data when a data longer than that of the note length data table is entered.

Figure 4:
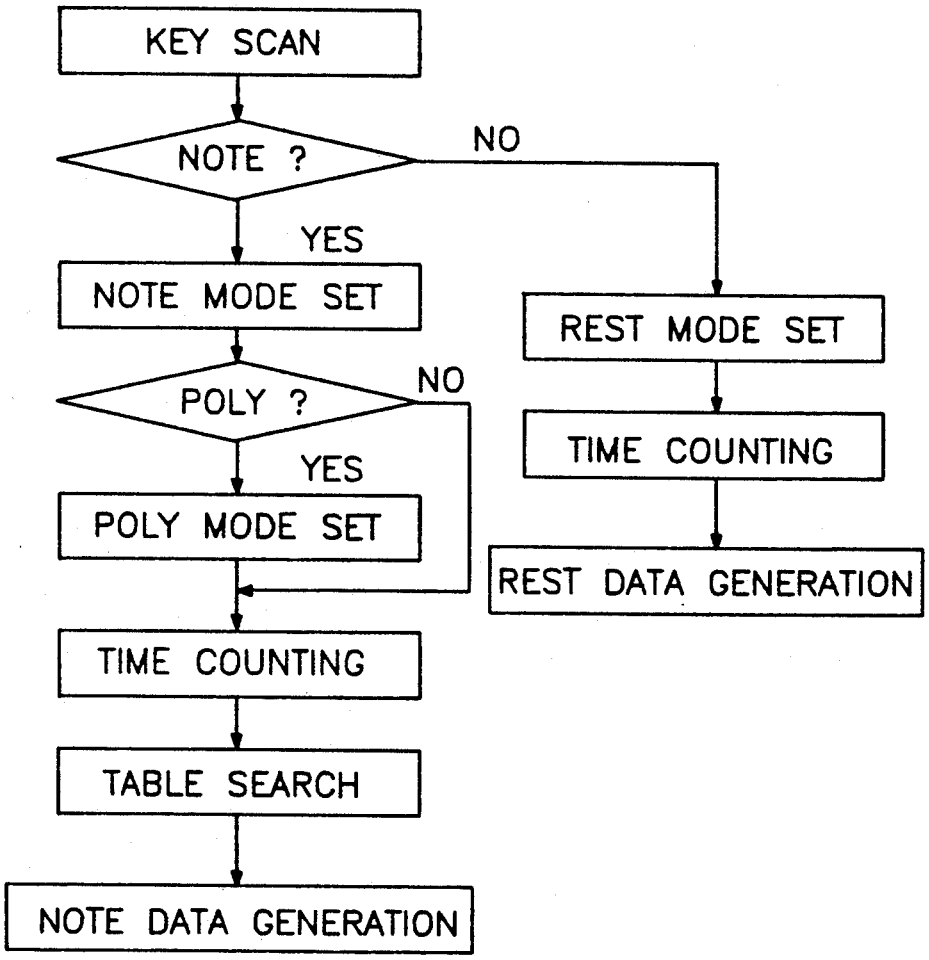
FIG. 4 is a flow chart showing the operating sequence of the apparatus of FIG. 3.

The music recording system of the present invention will now be detailedly described concerning its operations and effects referring to FIG. 4.

First, a discrimination is made as to whether it is a note or a rest by means of the key on/off information inputted through the key scanning circuit 1 of FIG. 3. Then, an N/R bit N/R is set, and in the case of a note, a discrimination is made as to whether it is a polyphonic note in order to set a polyphonic bit P. When the N/R bit and the polyphonic bit are decided, the time interval of the duration of the key is counted by the counter 2 in accordance with the system clock CK, and the counted result is temporarily stored in the register Rg1. Then the pointers of the note length table are looped, and the looped result and the content of the register Rg1 are compared to each other. If a correspondence is seen between the content of the register Rg1 and the relevant data having the relevant length, then the comparator 5 generates a correspondence signal and the data of FIG. 6 is formed using the note number data NN read through the key scanning circuit 1, before using it in the RAM 4.

Thus, according to the present invention, the standard note length table can include data having 64 differect lengths (Lo-1.5, i.e., $2^6=64$), and therefore, a data having a length 8,000 times that of a whole note and a whole rest can be represented in two or one byte. Accordingly, a long melody can be recorded with a small memory capacity.

What is claimed is:

1. A music recording system on an electronic keyboard having a plurality of keys for generating key data, said system comprising: a key scanning circuit connected to the keyboard for reading and interpreting the key data from the keyboard, and for outputting key off information at times when no key data is generated, key on information when key data is generated and note number data when key on information is generated for identifying at least one key of the keyboard from which the key data is generated; a system clock for generating time signal pulses; a counter connected to the key scanning circuit and to the system clock for counting the time signal pulses in accordance with the system clock and based on said key on/off information from said key scanning circuit; a first register connected to the counter for latching output of said counter upon completing counting the time signal pulses; a ROM for storing a plurality of standard note lengths and rest lengths; a pointer generator for looping and reading the length of notes and rests stored in the ROM; a second register connected to the ROM for temporarily storing length data of the notes and rests read by said pointer generator; a comparator connected to the first and second registers for comparing data in said registers, and for generating a correspondence signal when correspondence is determined between the content of the first register and the length data of the notes and rests temporarily stored in the second register; an output control circuit connected to the first register, the key scanning circuit and the comparator for forming, into byte form, data of the counted values of said first register and the note number data of said key scanning circuit in accordance with the correspondence signal of said comparator; and a RAM connected to the output control circuit for recording the counted values and the note number data, whereby use of the length data of the notes and rests stored in the ROM enable more efficient use of memory capacity of the RAM for recording music with the system.

2. A music recording system on an electronic keyboard having a plurality of keys for generating key data, said system comprising: a key scanning circuit connected to the keyboard for reading and interpreting the key data from the keyboard, and for outputting key off information at times when no key data is generated, key on information when key data is generated and note number data when key on information is generated for identifying at least one key of the keyboard from which the key data is generated; a system clock for generating time signal pulses; a counter connected to the key scanning circuit and to the system clock for counting the time signal pulses in accordance with the system clock and based on said key on/off information from said key scanning circuit; a first register connected to the counter for latching output of said counter upon completing counting the time signal pulses: a ROM for storing a plurality of standard note lengths and rest lengths; a pointer generator for looping and reading the length of notes and rests stored in the ROM; a second register connected to the ROM for temporarily storing length data of the notes and rests read by said pointer generator; a comparator connected to the first and second registers for comparing data in said registers, and for generating a correspondence signal when correspondence is determined between the content of the first register and the length data of the notes and rests temporarily stored in the second register; an output control circuit connected to the first register, the key scanning circuit and the comparator for forming, into byte form, data of the counted values of said first register and the note number data of said key scanning circuit in accordance with the correspondence signal of said comparator, the byte data formed by said output control circuit comprising a byte consisting of a polyphonic bit for signaling a polyphonic key input, a note-rest discriminating bit for signaling either a key input or an absence of a key input and note/rest length bits for signaling the length of the key input, and a byte consisting of a continuation discriminating bit for continuously displaying length data when data longer than that of the note/rest length bits are entered and note number data for signaling the key from which the signal is entered; and a RAM connected to the output control circuit for recording the counted values and the note number data, whereby use of the length data of the notes and rests stored in the ROM enable more efficient use of memory capacity of the RAM for recording music with the system.

3. The music recording system on an electronic keyboard as claimed in claim 2, wherein the output control circuit is operative to set the note-rest discriminating bit by discriminating the note and rest in accordance with the key on/off information imputed from said key scanning circuit; such that if key off information is inputed, the time is counted to generate the rest data; and such that if key on information is inputed, a discrimination is made as to whether the key on information identifies a polyphonic key input in order to set the polyphonic bit, and wherein at the same time, a note data is generated in accordance with the correspondence between the counted data and the data of the note length table; and the note number data from said key scanning circuit are formed into byte forms before storing them into said RAM.

* * * * *